US008023849B2

(12) United States Patent
Kamijo

(10) Patent No.: US 8,023,849 B2
(45) Date of Patent: Sep. 20, 2011

(54) IMAGE FORMING APPARATUS AND IMAGE FORMING METHOD

(75) Inventor: Koichi Kamijo, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/759,503

(22) Filed: Apr. 13, 2010

(65) Prior Publication Data

US 2010/0260520 A1 Oct. 14, 2010

(30) Foreign Application Priority Data

Apr. 14, 2009 (JP) ..... 2009-097955

(51) Int. Cl.
*G03G 15/16* (2006.01)

(52) U.S. Cl. ..... 399/66; 399/121; 399/304

(58) Field of Classification Search ..... 399/66, 399/121, 297, 302–304, 308, 313
See application file for complete search history.

(56) References Cited

U.S. PATENT DOCUMENTS 3,612,677 A * 10/1971 Langdon et al. ..... 399/304
4,796,054 A * 1/1989 Maeno et al. ..... 399/200
6,243,556 B1 6/2001 Shin

FOREIGN PATENT DOCUMENTS

JP 03-004241 A 1/1991
JP 3128067 B 9/2000

* cited by examiner

*Primary Examiner* — David Porta
*Assistant Examiner* — Benjamin Schmitt
(74) *Attorney, Agent, or Firm* — Workman Nydegger

(57) ABSTRACT

An image forming apparatus, including: an image carrier for carrying an image; a transfer roller including a holder member that holds a transfer material, a groove portion in which the holder member is disposed, and an elastic member disposed over the transfer roller except a portion where the groove portion is disposed, the elastic member of the transfer roller is pressed onto the image carrier to transfer an image from the image carrier onto the transfer material; and a gate roller for transporting the transfer material to the holder member, wherein a circumferential velocity v1 (mm/sec) of the elastic member of the transfer roller is lower than a moving speed v2 (mm/sec) of the transfer material transported by the gate roller.

4 Claims, 7 Drawing Sheets

IMAGE FORMING APPARATUS AND IMAGE FORMING METHOD

BACKGROUND

1. Technical Field

The present invention relates to an image forming apparatus for forming images. The apparatus includes a transfer roller that has a groove portion in which a holder member for holding a transfer material is provided. The transfer roller is pressed onto a carrier that carries images.

2. Related Art

In wet-type image forming apparatuses using liquid developer, a transfer material tends to stick onto an intermediate transfer member after transfer of toner images. This is because the transfer surface of the transfer material such as paper is pressed onto the intermediate transfer member. The transfer surface of the transfer material is a surface on which toner images are transferred. Accordingly, such an image forming apparatus has been proposed that is adapted to remove a transfer material from a transfer roller by blowing air to a tip end of the transfer material, after transfer (see, for example, Japanese Patent No. 3128067).

Besides this apparatus, another image forming apparatus using a dry developer has been proposed (see, for example, JP-A-3-4241). This apparatus is adapted to transfer a toner image on a photosensitive member onto a transfer material while gripping a tip end portion of the transfer material using a gripper. The gripper is included in a transfer drum that is pressed onto the photosensitive member. Gripping the tip end portion of the transfer material during the transfer process allows the transfer material to be smoothly removed from the photosensitive member after the transfer.

However, the image forming apparatus disclosed in Japanese Patent No. 3128067 may fail to remove the transfer material successfully since the apparatus is adapted to merely blow the air to the tip end portion of the transfer material.

Thus, the technology for removing a transfer material by gripping the tip end portion of the transfer material using the gripper disclosed in JP-A-3-4241 may be applied to the image forming apparatus using the liquid developer that is disclosed in Japanese Patent No. 3128067. However, the gripper, which is a holder member used for holding the transfer material, continuously moves during the transfer operation since the gripper is included in the transfer drum and rotates integrally therewith. Therefore, it is difficult to appropriately and stably hold the transfer material being transported to the transfer drum by the holder member at a predetermined position of the transfer material. Further, in JP-A-3-4241, ways of holding the transfer material appropriately and stably at a predetermined position by the holder member that continuously moves in the image forming apparatus are not disclosed.

Thus, it is difficult to successfully perform image formation with a combination of the technology for removing the transfer material disclosed in JP-A-3-4241 and the image forming apparatus disclosed in Japanese Patent No. 3128067.

SUMMARY

An advantage of some aspects of the invention is that it provides an image forming apparatus and an image forming method which are adapted to appropriately and stably hold a transfer material before transfer in order to perform excellent image formation.

An image forming apparatus and an image forming method according to an aspect of the invention use a transfer roller. The transfer roller includes a holder member for holding a transfer material, a groove portion in which the holder member is disposed, and an elastic member disposed over the transfer roller except for a portion where the groove portion is disposed. The elastic member of the transfer roller is pressed onto an image carrier. According to the aspect of the invention, the image forming apparatus further includes a gate roller that transports the transfer material to the holder member of the transfer roller. A circumferential velocity v1 (mm/sec) of the elastic member of the transfer roller during a period over which the elastic member makes contact with a carrier is set to be lower than a moving speed v2 (mm/sec) of the transfer material. Accordingly, the transfer material is appropriately and stably held by the holder member at a predetermined position before transfer, after the transfer material is appropriately moved. Consequently, a secondary transfer is performed on the transfer material that is appropriately and stably held, which allows excellent image formation.

A Second circumferential velocity v3 (mm/sec) of the elastic member of the transfer roller during a period over which the elastic member does not make contact with the image carrier is set to be higher than the circumferential velocity v1 (mm/sec) and is set to be lower than the moving speed v2 (mm/sec) of the transfer material. Accordingly, the transfer material can be held by the holder member more appropriately prior to the secondary transfer.

Further, in this aspect of the invention, pressing contact force by the transfer roller against the image carrier is directed to generate a vector component that is oriented toward the movement direction of the transfer material. Accordingly, when the transfer material is pinched between the transfer roller and the image carrier, the vector component effectively acts to pull the transfer material into a transfer nip. This allows the transfer material to be held by the holder member more appropriately and stably.

Further, this aspect of the invention includes a rotation speed detector and a controller. The rotation speed detector detects the rotation speed of the transfer roller. The controller controls the circumferential velocity of the transfer roller on the basis of the rotation speed of the transfer roller detected by the rotation speed detector. Accordingly, the circumferential velocity of the transfer roller can be controlled in accordance with the moving speed of the transfer material more precisely.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment of the invention will be described hereinafter with reference to the drawings.

Figure 1:
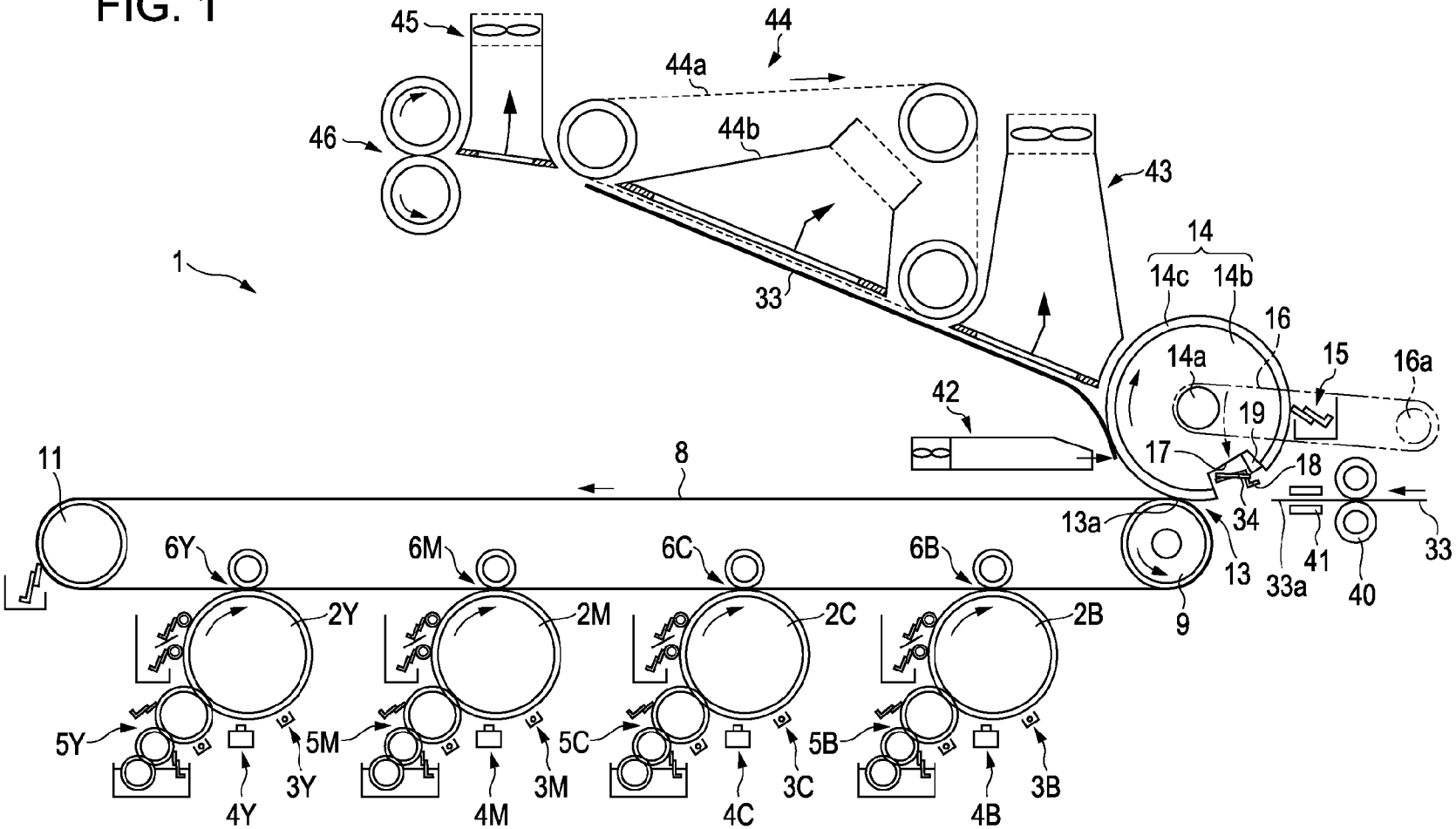
FIG. 1 is a schematic partial drawing showing an example of an embodiment of an image forming apparatus according to the invention.

FIG. 1 is a schematic partial drawing showing an example of an embodiment of an image forming apparatus according to the invention.

The embodiment of the image forming apparatus 1 uses a liquid developer containing solid toner and carrier liquid to perform image formation. As shown in FIG. 1, the image forming apparatus 1 has photosensitive members 2Y, 2M, 2C, 2K that are image carriers of yellow (Y), magenta (M), cyan (C), and black (K), respectively, and that are disposed horizontally or generally horizontally. 2Y, 2M, 2C, 2K represent the photosensitive members of yellow, magenta, cyan and black, respectively. Other members of the image forming apparatus are also indicated with Y, M, C, K to represent the colors that the components are associated with.

Each of the photosensitive members 2Y, 2M, 2C, 2K is provided at its outer circumference with charged portions 3Y, 3M, 3C, 3K, respectively. Further, exposure portions 4Y, 4M, 4C, 4K, development portions 5Y, 5M, 5C, 5K, and primary transfer portions 6Y, 6M, 6C, 6K are disposed in this order from the respective charged portions 3Y, 3M, 3C, 3K in the rotational direction of the respective photosensitive members 2Y, 2M, 2C, 2K. Each of the photosensitive members 2Y, 2M, 2C, 2K is provided with respective cleaning portions (not shown), which clean the respective photosensitive members.

The image forming apparatus 1 includes an intermediate transfer belt 8 (which corresponds to the image carrier) constructed by an endless transfer belt. The intermediate transfer belt 8 is disposed above the photosensitive members 2Y, 2M, 2C, 2K. The intermediate transfer belt 8 is pressed onto the photosensitive members 2Y, 2M, 2C, 2K at the primary transfer portions 6Y, 6M, 6C, 6K, respectively.

The intermediate transfer belt 8 is a relatively soft elastic belt consisting of a three-layer structure (not shown), which includes a flexible base material such as resin, an elastic layer such as rubber formed over the base member, and a surface layer formed over the elastic layer. The intermediate transfer belt 8, however, is not restricted to such a structure and materials, and it can be made of other structures and materials. The intermediate belt 8 is suspended with tension between a driving roller 9 and a tension roller 11 of the intermediate transfer belt 8. Driving force is transmitted to the driving roller 9 from a motor (not shown). The intermediate transfer belt 8 is adapted to rotate with applied tension in the direction indicated by the arrow in the drawing.

The order of the positions of the components such as the photosensitive members corresponding to the colors of Y (yellow), M (magenta), C (cyan), K (black) is not restricted to that shown in FIG. 1, and the photosensitive members can be positioned in any other order.

A secondary transfer portion 13 is provided to a side of the driving roller 9 of the intermediate transfer belt 8. The secondary transfer portion 13 has a transfer mechanism. The secondary transfer portion 13 includes a secondary transfer roller 14 and a cleaning portion 15 for the secondary transfer roller 14.

The secondary transfer roller 14 has a groove portion 17 that extends in an axial direction of the secondary transfer roller 14. The secondary transfer roller 14 includes an elastic member 14 having a sheet form, which is wound on a circumference surface of a circular portion of a base 14*b*. The elastic member 14*c* forms a resistance layer on the circumference surface of the circular portion of the secondary transfer roller 14.

Figure 2:
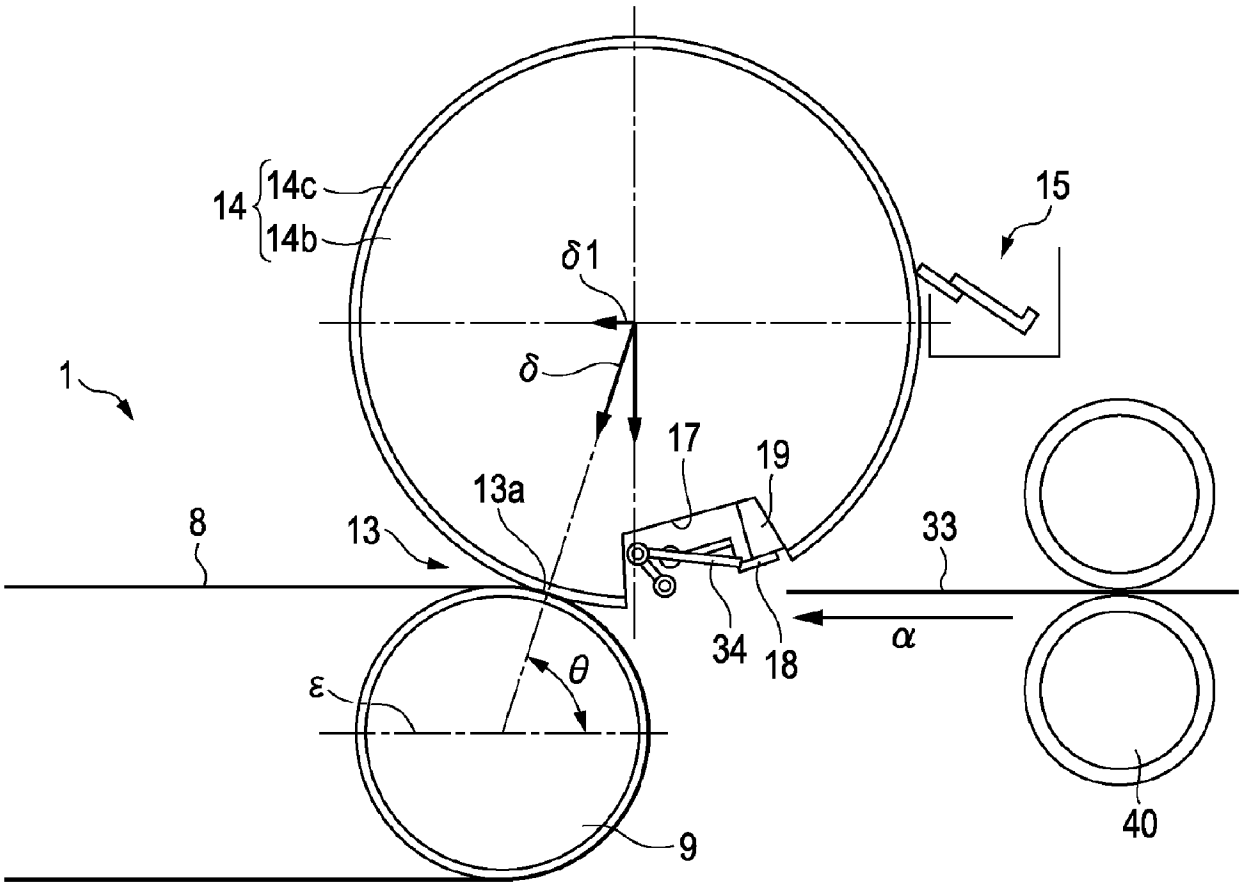
FIG. 2 is an explanatory drawing showing a direction along which a secondary transfer roller is pressed.

Two end portions of a rotary shaft 14*a* of the secondary transfer roller 14 are rotatably supported by a pair of support frames 16 of the secondary transfer roller 14. The support frame 16 of the secondary transfer roller 14 rotates and swings about a rotary axis 16*a* (a rotational point) supported by a main body of the apparatus (not shown). The support frame 16 is pressed in the direction indicated by the arrow shown in the drawing by a pressing means such as a spring (not shown). The pressing contact force of the pressing means acts to press the secondary transfer roller 14, thereby causing the elastic member 14*c* to be pressed onto the intermediate transfer belt 8. Accordingly, as shown in FIGS. 1 and 2, a secondary transfer nip 13*a* is formed between the intermediate transfer belt 8 and the elastic member 14*c* of the secondary transfer roller 14. In this state, the driving roller 9 of the intermediate transfer belt 8 acts as a backup roller against the pressing contact force of the secondary transfer roller 14.

As shown in FIG. 2, the elastic member 14*c* of the secondary transfer roller 14 is pressed onto the intermediate transfer belt 8 as the pressing contact force from the pressing means is applied in the application direction $\delta$. The application direction $\delta$, which is the direction of the pressing contact force, points toward the rotational center of the driving roller 9 of the intermediate transfer belt 8 through a linear line that passes a rotational center of the secondary transfer roller 14, a center of a width of the secondary transfer nip 13*a* with respect to a rotational direction of the secondary transfer roller 14, and a rotational center of the driving roller 9 of the intermediate transfer belt 8. The application direction $\delta$, is at an angle of $\theta$ with respect to an imaginary horizontal line $\epsilon$. That is, the application direction $\delta$ has a vector element $\delta 1$ pointing in the same direction as the movement direction $\alpha$ of the transfer material 33 that is transported from a gate roller 40. The Force of the vector element $\delta 1$ of the application direction $\delta$ allows the transfer material 33 that has reached the secondary transfer nip 13*a* to be pinched between the elastic member 14*c* of the secondary transfer roller and the intermediate transfer belt 8, and allows the transfer material 33 to be pulled into the secondary transfer nip 13*a*.

Further, the secondary transfer roller 14 is applied with transfer bias to transfer the image onto the transfer material such as transfer paper. The secondary transfer roller 14 applied with the transfer bias transfers the toner from the intermediate transfer belt 8 onto the transfer material 33 at the secondary transfer nip 13*a*. The secondary transfer roller 13 rotates in the direction indicated by the arrow with the intermediate transfer belt 8 that rotates in the direction indicated by the arrow.

In the groove portion 17 of the secondary transfer roller 14, there are disposed a gripper 18 which is used as the holder member for holding the transfer material 33 in the invention, and a gripper support portion 19 which is a member for receiving the holder member (gripper 18). A plurality of the grippers 18 are disposed along an axial direction of the secondary transfer roller 14 in a comb-teeth manner (not shown).

A plurality of gripper support members 19 are disposed corresponding to the respective grippers 18.

Figure 3:
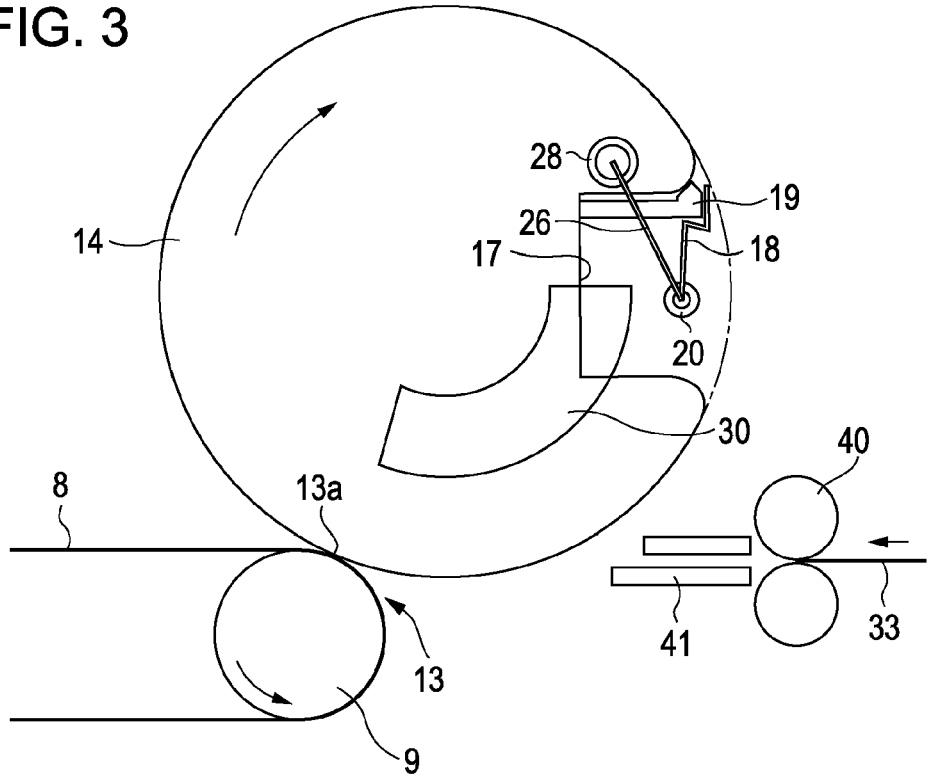
FIG. 3 is an explanatory drawing showing a part of a process of holding a transfer material using a gripper.

As shown in FIG. 3, each gripper 18 is provided to a rotary shaft 20 to integrally rotate with the rotary shaft 20. One end of the rotary shaft 20 is provided with a cam follower 28 for controlling the gripper 18 with an arm 26. A rotation of the secondary transfer roller 14 allows the cam follower 28 to be controlled by a gripper control cam 30 fixed to a main body of the apparatus. The cam follower 28 controls the contact and withdrawal of the gripper 18 with respect to the support portion 19. A tip end portion 33*a* of the transfer material 33 transported by the gate roller 40 through a transport guide 41 is pinched between the gripper 18 and a holding portion 19*b* of the gripper support member 19, right before the groove portion 17 reaches the secondary transfer nip 13*a* (a process of transporting the transfer material, and a process of holding the transfer material).

The operation where the tip end portion 33*a* of the transfer material 33 transported from the gate roller 40 is held by the gripper 18 will be described in detail. A first circumferential velocity v1 (mm/sec) of the elastic member 14*c* of the secondary transfer roller 14 when the elastic member 14*c* is pressed onto the intermediate transfer belt 8 by the pressing contact force of the pressing means is set to be lower than a transporting speed v2 (mm/sec) (which is the moving speed of the transfer material 33) of the transfer material 33 transported from the gate roller 40 (v1<V2). Further, a second circumferential velocity (v3 mm/sec) of the elastic member 14*c* of the secondary transfer roller 14 when the elastic member 14*c* of the secondary transfer roller 14 is not pressed onto the intermediate transfer belt 8 is also set to be lower than the moving speed v2 (mm/sec) of the transfer material (v3<V2). When the elastic member 14*c* of the secondary transfer roller 14 is not pressed to the intermediate transfer belt 8, the rotation of the secondary transfer roller 14 receives slight resistance. Therefore, the second circumferential velocity (v3 mm/sec) of the elastic member 14*c* of the secondary transfer roller 14 becomes higher than the first circumferential velocity v1 (mm/sec) of the elastic member 14*c* of the secondary transfer roller 14 (v1<v3<v2).

As shown in FIG. 3, the gripper 18 is disposed so as to contact the gripper support portion 19 and so as not to hold the transfer material 33, before the gripper 18 rotationally reaches a position where the transfer material 33 is provided to the secondary transfer roller 14 from the gate roller 40. The rotation of the secondary transfer roller 14 in the direction indicated by the arrow causes the gripper 18 to come closer to the position where the transfer material 33 is provided from the gate roller 40. In this stage the elastic member 14*c* contacts the intermediate transfer belt 8, so that the elastic member 14*c* of the secondary transfer roller 14 rotates at a circumferential velocity of v1. Then, the cam follower 28 comes into contact with a cam surface of the gripper control cam 30. Then, the cam follower 28 is controlled by a gripper control cam 30 as the secondary transfer roller 14 rotates in the same direction.

Figure 4:
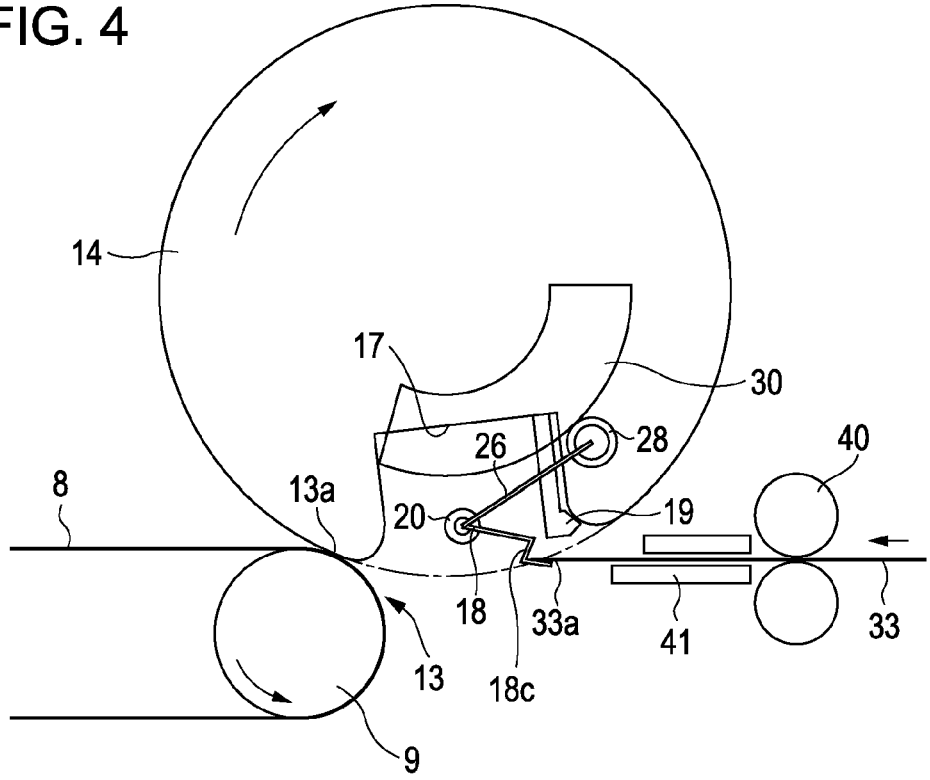
FIG. 4 is an explanatory drawing showing another part of the process of holding the transfer material using the gripper.

When the gripper 18 reaches near the position where the transfer material 33 is provided, the gripper 18 is separated from the gripper support portion 19 by the cam follower 28 that is controlled by the gripper control cam 30. Then, as shown in FIG. 4, when the gripper 18 reaches the position where the transfer material 33 is provided, the tip end portion 33*a* of the transfer material 33 enters between the gripper 18 and the gripper support portion 19. In this stage, the transfer material 33 enters appropriately and stably between the gripper 18 and the gripper support portion 19, and the tip end of the transfer material 33 contacts a step portion 18*c* of the gripper 18. This occurs because the first circumferential velocity v1 of the elastic member 14*c* of the secondary transfer roller 14 is set to be lower than the moving speed v2 of the transfer material 33.

Figure 5:
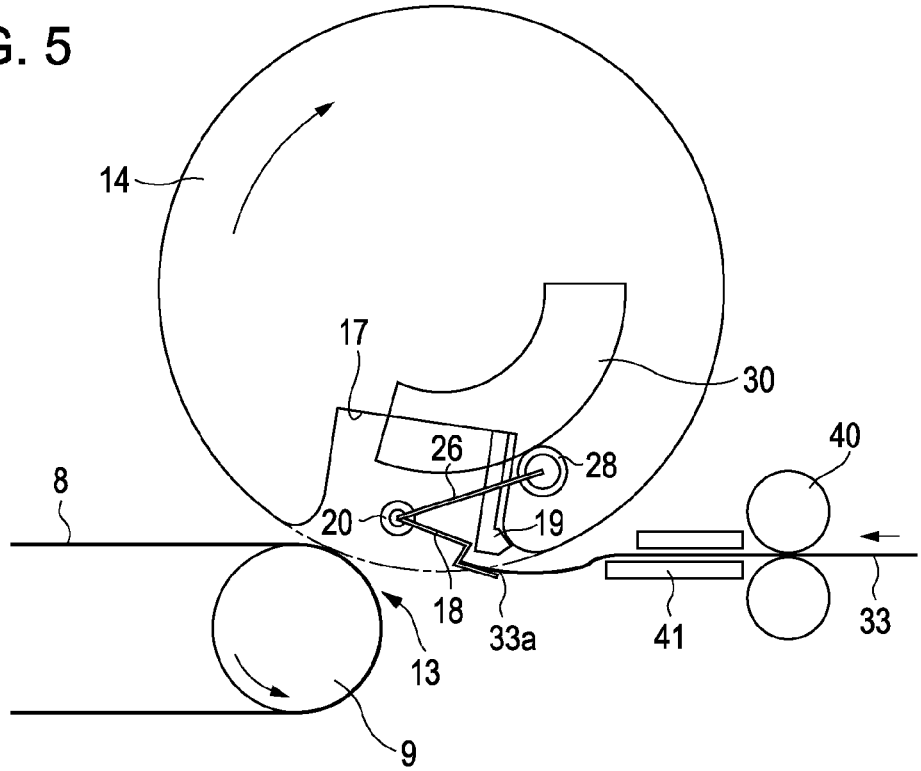
FIG. 5 is an explanatory drawing showing still another part of the process of holding the transfer material using the gripper.

Further, rotation of the secondary transfer roller 14 in the same direction causes the groove portion 17 to begin to face a position where a nipping operation for the secondary transfer will be performed. Then, as shown in FIG. 5, the secondary transfer roller 14 separates from the intermediary transfer belt 8, which slightly increases the rotational speed of the secondary transfer roller 14, causing the secondary transfer roller 14 to eventually rotate with the second circumferential velocity v3. The difference in speed between the second circumferential velocity v3 of the secondary transfer roller 14 and the moving speed v2 of the transfer material allows the contact of the tip end of the transfer material 33 to the corner of the step portion 18*c*, thereby the position of the transfer material 33 with respect to the gripper 18 is determined.

Figure 6:
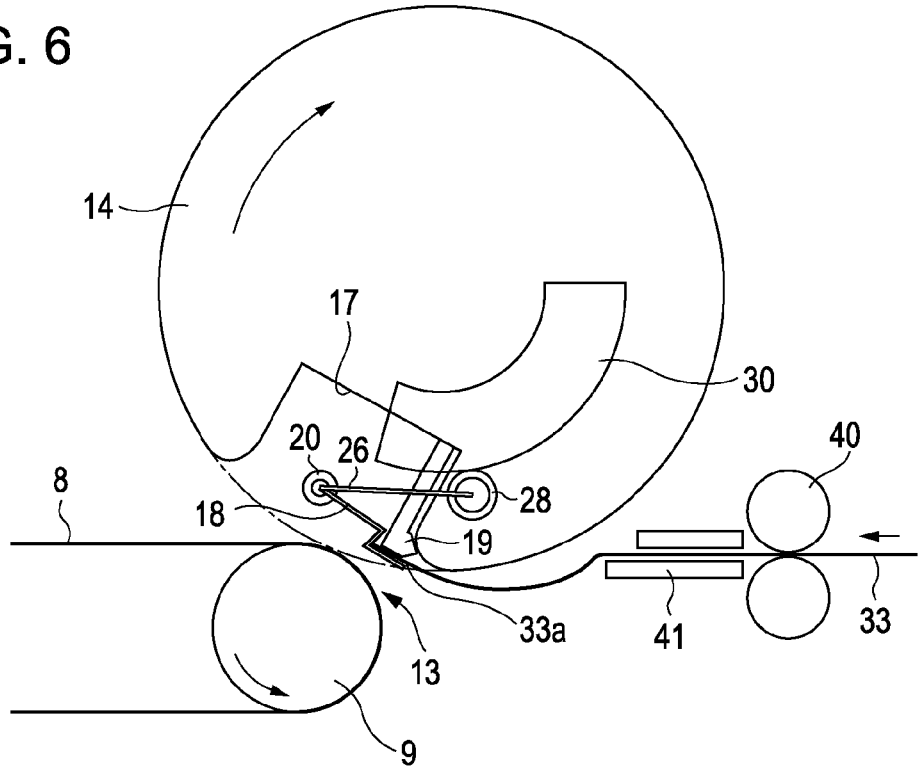
FIG. 6 is an explanatory drawing showing still another part of the process of holding the transfer material using the gripper.

As shown in FIG. 6, further rotation of the secondary roller 14 permits the gripper 18 to come closer to the gripper support portion 19 to hold the tip end portion 33*a* of the transfer material 33 by pressing the transfer material 33 onto the gripper support portion 19. In this stage, the positioned tip end portion 33*a* of the transfer material 33 enables the transfer material 33 to be held appropriately and stably by the gripper 18 at a predetermined position. The holding force of the gripper 18 used for transferring the transfer material 33 is set so as to be smaller than the transporting force of the gate roller 40 used for transporting the transfer material 33 (the holding force of the gripper 18<the transporting force of the gate roller 40). The holding force set so as to be smaller than the transporting force can prevent the transfer material 33 from receiving any scratches or creases. The transfer material 33 appropriately positioned with respect to the secondary transfer roller 14 is transported appropriately toward the secondary transfer nip 13*a* with the rotation of the secondary transfer roller 14. In this stage the tip end portion 33*a* of the transfer material 33 is caused to bend because the moving speed v2 of the transfer material 33 is set to be higher than the second circumferential velocity v3 of the secondary transfer roller 14.

Figure 7:
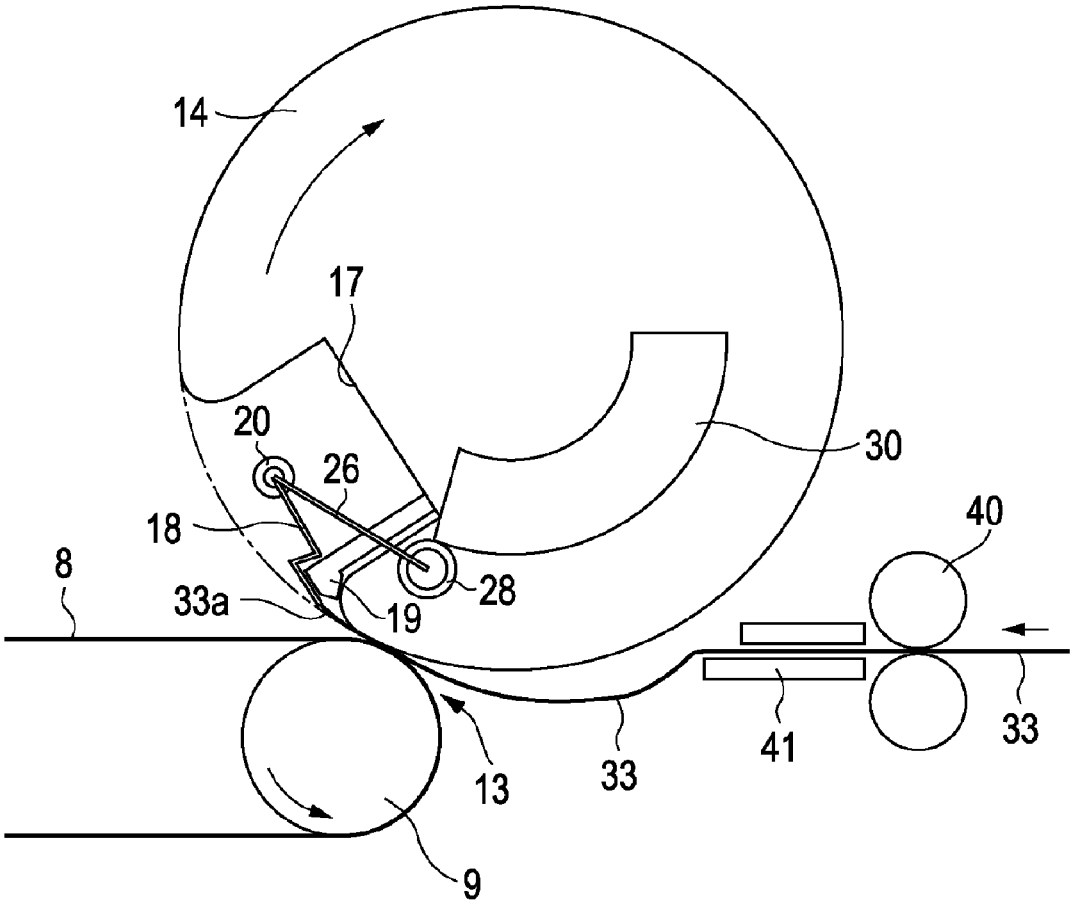
FIG. 7 is an explanatory drawing showing still another part of the holding process of the transfer material using the gripper.

As shown in FIG. 7, a toner image on the intermediate transfer belt 8 is transferred onto the transfer material 33 at the second transfer nip 13*a* (transfer process). After the transfer of the toner image is completed, the tip end portion 33*a* of the transfer material 33 held by the gripper 18 passes through the second transfer nip 13*a*, and the cam follower 28 separates from the gripper control cam 30. Then, the gripper 18 separates from the gripper support portion 19, thereby releasing the tip end portion 33*a* of the transfer material 33.

The circumference length of the secondary transfer roller 14 excluding the length of the groove portion 17 in the rotational direction is set to be larger than that of a type of transfer material 33 having the largest length in the movement direction among transfer materials used in this image forming apparatus 1. This allows the toner image onto the intermediate transfer belt 8 to be transferred appropriately onto the transfer material 33 having the largest length.

A desired number of detouching members 34 for detouching the transfer material 33 are disposed in the groove portion 17 in a direction perpendicular or generally perpendicular to the direction the transfer material 33 is transported (the axial direction of the secondary transfer roller 14). Each of the detouching members 34 moves linearly between its retracted position and pushed out position. The linear movement of the push claw 34 is controlled by a control cam (not shown) fixed in the main body of the apparatus.

Each of the detouching members 34 is moved to its pushed out position when the transfer material 33 is released from the gripper 18 that has passed through the second transfer nip 13*a*. The rear face of the transfer material 33 (the side opposite the surface on which the toner image is transferred) then is pushed out by the push claw 34. Accordingly, the transfer material 33 is removed from the secondary transfer roller 14.

This embodiment of the image forming apparatus 1 is adapted to detect the circumferential velocity of the secondary transfer roller 14, the circumferential velocity of the gate roller 40, and the moving speed of the transfer material 33 in order to control them.

Figure 8:
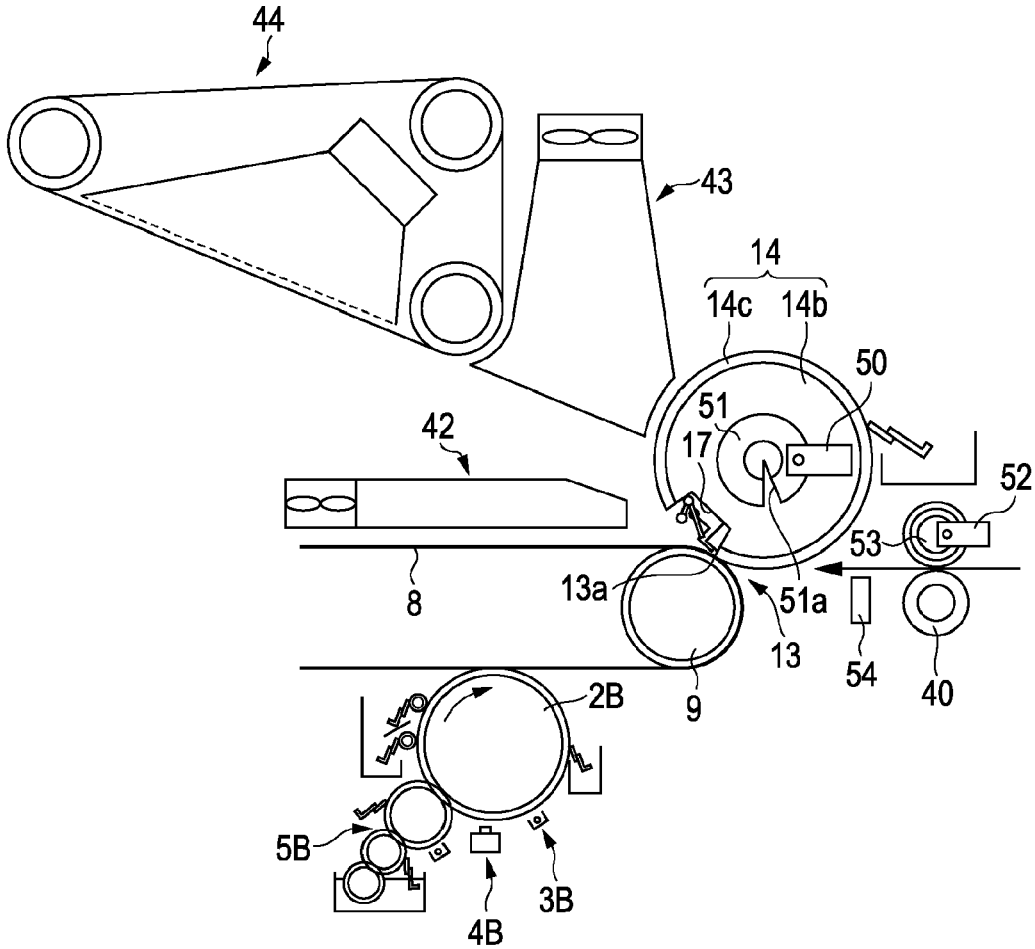
FIG. 8 is a schematic drawing showing positions of detectors, each used for detecting the rotational speed of a secondary transfer roller, the rotational speed of a gate roller, and the moving speed of the transfer material, respectively.

As shown in FIG. 8, an encoder 50 and a code wheel 51 nearby the encoder 50 are provided at one side of the secondary transfer roller 14. The encoder (speed detector) 50 detects the circumferential velocity of the secondary transfer roller 14. The code wheel 51 constructed by a circular plate having a slit (notch) 51*a* is provided to a rotary shaft 14*a* of the secondary transfer roller 14 so as to rotate integrally with the secondary transfer roller 14. The encoder 50 and the code wheel 51 may be ones conventionally used. The encoder 50 detects the angular speed ω (rpm) of the slit 51*a* of the code wheel 51. The detected angular speed ω of the secondary transfer roller 14 is used to calculate the circumferential velocity (mm/sec) of the outer circumference surface of the secondary transfer roller 14 using a regular formula.

Another encoder 52 and a code wheel 53 nearby the encoder 52 are provided at one side of the gate roller 40. The encoder (speed detector) 52 is used to detect the circumferential velocity of the gate roller 40. The encoder 52 and the code wheel 53 are of the same types as the encoder 50 and the code wheel 51, respectively. The detected angular speed of the gate roller 40 is used to calculate the circumferential velocity of the gate roller 40 like in the case of the secondary transfer roller 14.

Figure 9:
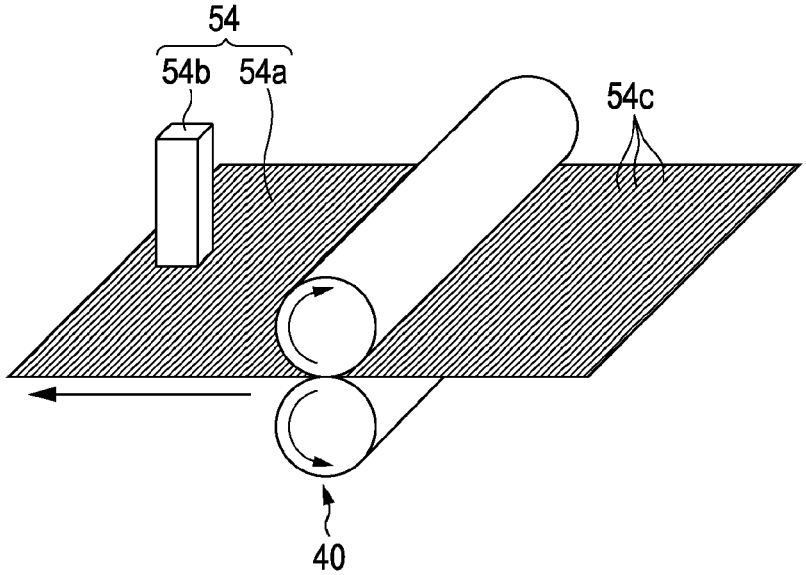
FIG. 9 is a schematic drawing showing the detector that is used for detecting the moving speed of the transfer material.

A speed detector 54 for detecting the moving speed (transporting speed) of the transfer material 33 is disposed between the secondary transfer nip 13*a* and the gate roller 40. As shown in FIG. 9, the speed detector 54 includes a speed detection transfer material 54*a* and an optical speed detection sensor 54*b*. The speed detection transfer material 54*a* has many thin lines 54*c* printed thereon and extending perpendicularly or generally perpendicularly in the movement direction (transporting direction) of the transfer material 54*a*. The thin lines 54*c* are formed at regular intervals (for example, 100 μm pitch) in the movement direction of the transfer material 54*a*.

The optical speed detection sensor 54*b* can be a reflection type sensor, for example. The optical speed detection sensor 54*b* detects the thin lines 54*c* when the speed detection transfer material 54*a* is passed through the second transfer nip 13*a*. The detected time interval of the thin lines 4*c* is used to detect the speed of the detection transfer material 54*a* and eventually the transfer material 33 by passing the transfer material 54*a* through the second transfer nip 13*a*. When the detected time of one pitch of the thin lines 4*c* by the optical speed detection sensor 54*b* is 0.0004 sec (0.4 μsec), for example, the speed of the transfer material 54*a* is: $(100\times10^{-3})/0.0004=250.0$ mm/sec.

Figure 10:
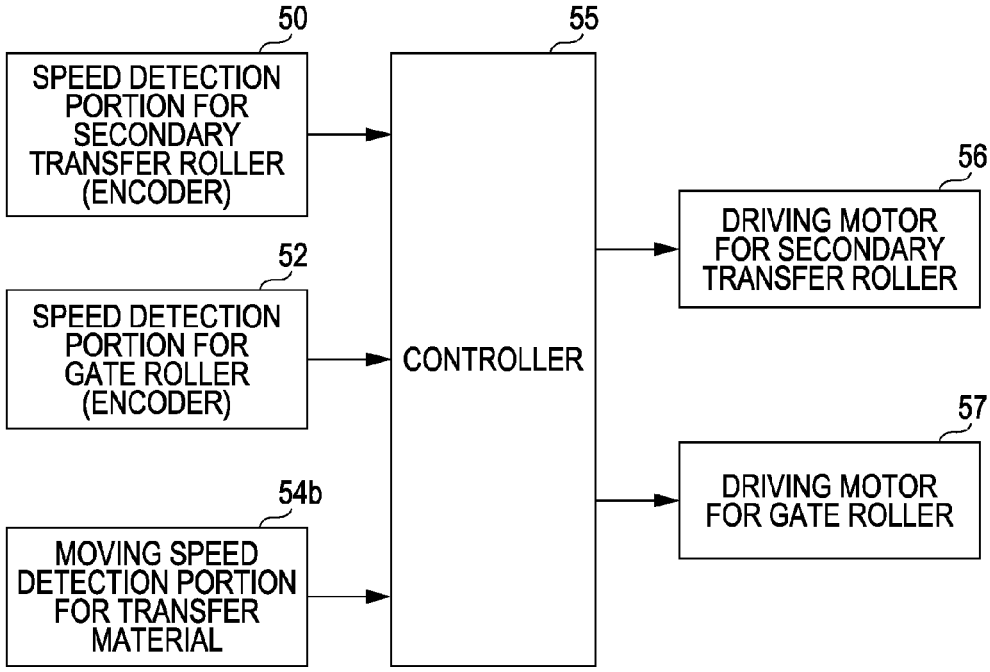
FIG. 10 is a block diagram showing a speed controller.

The circumferential velocity of both the secondary transfer roller 14 and the gate roller 40 is controlled by an electron controller (controller) of the image forming apparatus 1. That is, as shown in FIG. 10, the detected signals of the angular speed of the secondary transfer roller 14 by the encoder 50, the detected signals of the angular speed of the gate roller 40 by the encoder 52, and the detected signals of the moving speed of the transfer material 54*a* by the optical speed detection sensor 54*b* are input to the controller 55, respectively. The controller 55 controls the rotation of a driving motor 56 used for the secondary transfer roller 14 and a driving motor 57 used for the gate roller 40 on the basis of the detected signals. With such an arrangement, the circumferential velocities of the secondary transfer roller 14 and the gate roller 40 can be controlled appropriately.

The cleaning portion 15 of the secondary transfer roller 14 removes the liquid developer adhered on the elastic member 14*c* of the secondary transfer roller 14 using a cleaning member such as a cleaning blade. The liquid developer removed by the cleaning member is put back into a container for storing liquid developer.

Returning to FIG. 1, the image forming apparatus 1 includes a first airflow generator 42, a second airflow generator 43, a transfer material transport portion 44, a third airflow generator 45, and an anchor portion 46. The first airflow generator 42 blows air to the tip end portion 33*a* of the transfer material 33 that has been released from the gripper 18, as shown by the arrow. This prevents the tip end portion 33*a* of the transfer material 33 from moving integrally with the intermediate transfer belt 8. The second airflow generator 43 sucks air in the direction indicated by the arrow. The rear face of the transfer material is subjected to suction as a result of the air being sucked by the second airflow generator 43, after the transfer material 33 is removed from the secondary transfer roller 14. Accordingly, the transfer material 33 moves forward toward the transfer material transport portion 44 by the rotation of the intermediate transfer belt 8 and the secondary transfer roller 14, while it is guided by the air sucked by the second airflow generator 43.

The transfer material transporter 44 includes an endless type of a transport belt 44*a* to be rotated in the direction indicated by the arrow, and a suction member 44*b* for sucking air in the direction indicated by the arrow. The transfer material 33 moved to the transfer material transporter 44 is transported toward the third airflow generator 45 by the transport belt 44*a* while it is subjected to suction by the air generated by the suction member 44*b*. The third airflow generator 45 sucks air in the direction indicated by the arrow. The rear face of the transfer material is subjected to suction as a result of the air being sucked by the third airflow generator 45, which has been removed from the secondary transfer roller 14. Accordingly, the transfer material 33 moves toward the anchor portion 46 by the rotation of the transport belt 44*a*, while it is guided by the air sucked by the third airflow generator 45. In the anchor portion 46 the toner image on the transfer material 33 is heat-pressed and fixed thereon.

Other constructions and image forming operations of the embodiment of the image forming apparatus 1 are similar to those in a conventional image forming apparatus using a liquid developer, thus descriptions thereof are excluded from this specification.

According to the embodiment of the image forming apparatus 1, the first circumferential velocity v1 (mm/sec) of the elastic member 14*c* of the secondary transfer roller 14, when the elastic member 14*c* is pressed onto the intermediate transfer belt 8 by the pressing contact force of the pressing means, is set to be lower than the moving speed v2 (mm/sec) of the transfer material 33 transported from the gate roller 40 (v1<v2). This allows appropriate and stable holding of the transfer material 33 by the gripper 18 before the secondary transfer is performed, by moving the tip end portion 33*a* of the transfer material 33 to the position at which the transfer material 33 is held by the gripper 18. Consequently, the secondary transfer is appropriately performed on the transfer material 33 which has been appropriately and stably held, which results in improved efficient transfer performance and excellent image formation.

Further, the second circumferential velocity v3 (mm/sec) of the secondary transfer roller 14 is set so as to be higher than the first circumferential velocity v1 (mm/sec) of the elastic member 14*c* of the second transfer roller 14, and is set so as to be lower than the moving speed v2 (mm/sec) of the transfer material 33, when the secondary transfer roller 14 is released from the intermediate transfer belt 8 as the groove portion 17 faces the intermediate transfer belt 8. Accordingly, the transfer material 33 can be held by the gripper 18 more appropriately, before the secondary transfer.

Further, the controller controls the speed of the secondary transfer roller 14 on the basis of the rotation speed of the secondary transfer roller 14 detected by the encoder 50. The controller also controls the rotation speed of the gate roller 40 detected by the encoder 52. The controller further controls the moving speed of the transfer material 33 detected by the optical speed detection sensor 54*b*. Accordingly, the circumferential velocity of the transfer roller 14 can be controlled in response to the moving speed of the transfer material 33 more precisely.

Further, the image formed by the liquid developer consisting of toner and carrier liquid, which has been transferred on the intermediate transfer belt 8, is transferred onto the transfer material 33, while holding the tip end portion 33*a* of the transfer material 33 by the gripper. Such a construction enables removal of the transfer material 33 from the intermediate transfer belt 8 more appropriately, after the transfer. Thus, the transfer material 3 can be transported more appropriately and stably, while assuring the removal of the transfer material 33 from the intermediate transfer belt 8.

In the image forming apparatus 1 according to the embodiment, the application direction δ has a vector component δ1 that points in the same direction as the movement direction α of the transfer material 33 transported from the gate roller 40. The application direction δ is a direction along which the elastic material 14*c* of the secondary roller 14 presses the intermediate transfer belt 8. The force of the vector component δ1 acts to pull the transfer material 33 in the secondary transfer nip 13*a* appropriately, when the transfer material 33 is pinched between the elastic material 14*c* of the secondary transfer roller 14 and the intermediate transfer belt 8. This allows further appropriate and stable holding of the transfer material 33 by the gripper 18.

The embodiment of the image forming apparatus 1 according to the invention will be described more specifically.

The first circumferential velocity v1 of the secondary transfer roller 14 is fixed to 250 mm/sec; the moving speed v2 of the transfer material 33 is fixed to 253 mm/sec, which is 1.2% greater than the circumferential velocity v1 of the elastic member 14*c* of the secondary transfer roller 14; and the second circumferential velocity v3 of the elastic member 14*c* of the secondary transfer roller 14 is fixed to 250.5 mm/sec. That is v1<v3<v2.

The pressing contact force (nip load) of the secondary transfer roller 14 is fixed to 90 kgf (900 N). The width of the secondary transfer nip 13*a* (the length in the rotation direction of the secondary transfer roller 14) is fixed to 5 mm, and the length of the secondary transfer nip 13*a* (the length in the axial direction of the secondary transfer roller 14) is fixed to 300 mm. Consequently, the nip pressure P at the secondary transfer nip 13*a* is: P=900/0.5/30=60 [N/cm$^2$]. Further, as shown in FIG. 2, the angle θ of the pressing contact direction δ with respect to the imaginary horizontal line ϵ is set to 75 degrees, with the disposition of the driving roller 9 for the intermediate transfer belt 8 and the secondary transfer roller 14. The pressure component given by the vector component F1 of the pressing contact force F in the transportation direction of the transfer material 33 is: P cos 75°≈15.5 (N/cm$^2$).

These fixed speeds allow the appropriate and stable holding of the transfer material 33 by the gripper 18. Further, the pressure component given by the vector component in the pressing contact direction allows appropriate pulling of the transfer material 33 into the secondary transfer nip 13*a*.

The image forming apparatus and image forming method according to the invention are not restricted to the aforementioned embodiment. For example, the image forming apparatus 1 according to the embodiment uses the intermediate transfer belt 8 as an image carrier, but, instead, an intermediate transfer drum or a photosensitive member can be used. The photosensitive member if used as the image carrier can directly transfer the toner image onto the transfer material. The image forming apparatus according to the aforementioned embodiment is of a tandem type, but other types can be used including a one-colored image forming apparatus. The present invention includes a wide variety of embodiments within the scope of the inventions disclosed in the claims.

The entire disclosure of Japanese Patent Application No: 2009-97955, filed Apr. 14, 2009 is expressly incorporated by reference herein.

What is claimed is:

1. An image forming apparatus, comprising:

an image carrier that carries an image;

a transfer roller including a holder member that holds a transfer material, a groove portion in which the holder member is disposed, and an elastic member disposed over the transfer roller except a portion where the groove portion is disposed, the elastic member of the transfer roller is pressed onto the image carrier to transfer the image from the image carrier onto the transfer material; and a gate roller that transports the transfer material to the holder member, wherein a circumferential velocity v1 (mm/sec) of the elastic member of the transfer roller is lower than a moving speed v2 (mm/sec) of the transfer material transported by the gate roller, wherein a secondary circumferential velocity v3 (mm/sec) of the elastic member of the transfer roller is higher than the circumferential velocity v1 (mm/sec) and is lower than the moving speed v2 (mm/sec) of the transfer material, the secondary circumferential velocity v3 (mm/sec) is a speed at which the elastic material of the transfer roller does not contact the image carrier.

2. The image forming apparatus according to claim 1, wherein an application direction of a pressing contact force of the transfer roller against the image carrier has a vector component, the vector component points in the movement direction of the transfer material.

3. The image forming apparatus according to claim 1, the apparatus further comprising:

a speed detection portion that detects the circumferential velocity of the transfer roller; and a controller that controls a circumferential velocity of the transfer roller on the basis of a circumferential velocity of the transfer roller detected by the speed detection portion.

4. An image forming method, comprising:

transporting a transfer material by a gate roller at a moving speed v2 (mm/sec);

holding the transfer material transported by the gate roller by a holding member, the holding member being disposed in a groove portion of a transfer roller; and pressing the transfer material at a transfer nip, the transfer nip being formed between an image carrier that carries an image and an elastic member of the transfer roller, the transfer roller rotates at a circumferential velocity v1 (mm/sec) to transfer the image onto the transfer material, wherein a secondary circumferential velocity v3 (mm/sec) of the elastic member of the transfer roller is higher than the circumferential velocity v1 (mm/sec) and is lower than the moving speed v2 (mm/sec) of the transfer material, the secondary circumferential velocity v3 (mm/sec) is a speed at which the elastic material of the transfer roller does not contact the image carrier.

* * * * *